United States Patent [19]

Hayes

[11] 4,082,931

[45] Apr. 4, 1978

[54] ARC CHUTE

[75] Inventor: Matthew N. Hayes, Amherst, N.Y.

[73] Assignee: Westinghouse Electric Corporation, Pittsburgh, Pa.

[21] Appl. No.: 676,181

[22] Filed: Apr. 12, 1976

[51] Int. Cl.[2] ..... H01H 33/08

[52] U.S. Cl. ..... 200/144 C

[58] Field of Search ..... 200/144 C, 149 A

[56] References Cited

U.S. PATENT DOCUMENTS

| | | | |
|---|---|---|---|
| 2,270,723 | 1/1942 | Boehne | 200/144 C |
| 2,279,040 | 4/1942 | Grosse | 200/144 C |
| 2,822,448 | 2/1958 | Wegmann | 200/144 C |
| 2,911,505 | 11/1959 | Legg et al. | 200/144 C |
| 3,009,041 | 11/1961 | Zlupko | 200/144 C |

*Primary Examiner*—Robert S. Macon

*Attorney, Agent, or Firm*—L. P. Johns

[57] ABSTRACT

An arc chute for a circuit breaker characterized by a pair of spaced side walls for an interior arc extinguishing chamber, the surfaces of the walls forming the chamber being covered with a coating of an arc resistant ceramic material, such as aluminum oxide, zirconium oxide, chromic oxide, magnesium oxide, and calcium oxide.

1 Claim, 2 Drawing Figures

ARC CHUTE

BACKGROUND OF THE INVENTION

1. Field of the Invention

This invention relates to an arc chute of heat resistant material having a surface coating of an arc resistant ceramic material.

2. Description of the Prior Art

Arc chutes or arc shields are commonly used to confine and extinguish electric arc drawn between electrical contacts of circuit breakers. An arc chute is generally comprised of a pair of slightly spaced walls of heat resistant, electrically insulating material that confine and extinguish an arc by cooling the arc to extinguishing temperatures. An example of an arc shield is shown and described in U.S. Pat. No. 2,270,723, issued Jan. 20, 1942, in the name of Eugene W. Boehne.

A difficulty with some arc chutes of prior construction has been that the walls of the arc chute become heated during an arc lifetime to cause out-gassing of certain materials from the body of the arc chute walls. As a result the out-gas contributes to continuation of the arc rather than its extinguishment. Various attempts have been made to overcome the out-gassing problem but none have been commercially successful. One attempt has included heating of the arc chute during production for a sufficient time to drive out the gas. Such a heating process however is not economically feasible on a production basis.

SUMMARY OF THE INVENTION

In accordance with this invention, it has been found that the foregoing problem may be overcome by providing an arc chute or arc shield comprising a pair of spaced side walls of heat resistant, electrically insulating material forming an arc chamber, the walls having opposed surfaces defining the chamber, and each wall having a coating of an arc resistant ceramic material selected from the group consisting of aluminum oxide, zirconium oxide, chromic oxide, magnesium oxide, and calcium oxide.

The advantage of the device of this invention is an arc chute having an improved arc interruption and quenching property.

DESCRIPTION OF THE PREFERRED EMBODIMENT

Figure 1:
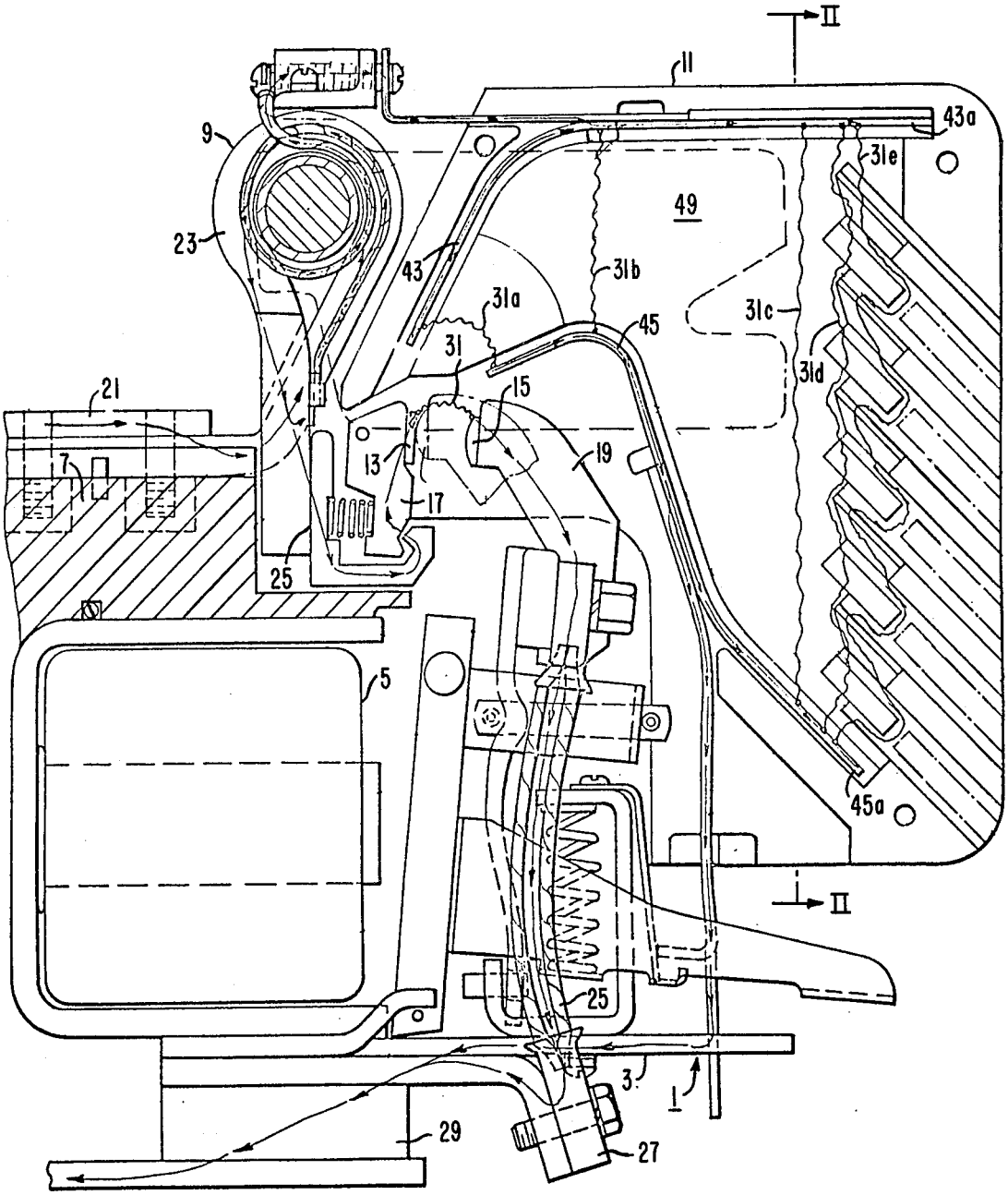
FIG. 1 is a vertical sectional view through a magnetic contactor having an arc chute mounted thereon.

In FIG. 1 a magnetic contactor is generally indicated at 1 and it comprises a base plate 3, electro-magnetic means or electromagnet 5, an electrically insulating housing 7, arc blowout unit 9, and an arc chute 11. The contactor 1 also comprises a stationary contact 13 and a movable contact 15 which are mounted on conductor structures 17, 19, respectively. The movable contact 15 is movable between open and closed positions, the latter of which is indicated by the broken line position 15*a*.

The contactor of this invention is generally described in U.S. Pat. No. 3,511,950, for which reason the description of the contactor per se is limited herein to the foregoing basic structure. Suffice it to say, an electric circuit through the contactor 1 includes a line terminal 21, a blowout coil 23, the contact support structures 25, 17, contacts 13, 15, the conductor structure 19, a shunt 25, a shunt connector 27, and a load terminal 29.

When the contacts 13, 15 separate under load, an arc 31 develops between them. The arc blowout unit and the arc chute 11 are provided to extinguish the arc 31 and minimize its effect upon the contacts. The arc chute 11 is a housing comprising a heat resistant, electrically insulating material, such as material filled melamine-formaldehyde resin. Other materials for the arc chute may include a mixture of Portland cement with asbestos, zircon, glass polyester, or the like. A very satisfactory composition for the material of the arc chute 11 comprises a mixture of melamine-formaldehyde resin with asbestos.

Figure 2:
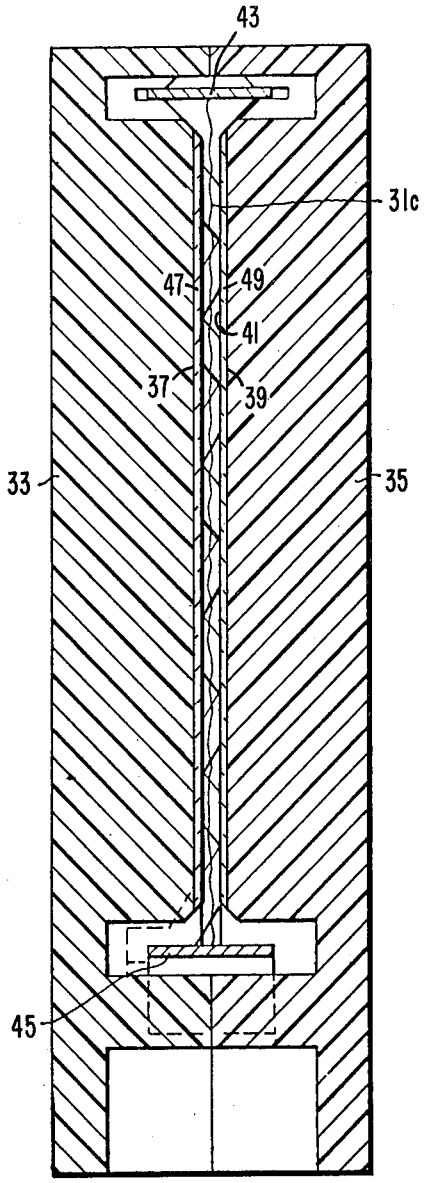
FIG. 2 is a vertical sectional view taken on the line II—II of FIG. 1.

The arc chute 11 preferably comprises two half portions 33, 35 (FIG. 2) having inner wall surfaces 37, 39 which surfaces are oppositely disposed or facing surfaces and provide an elongated narrow arc chamber 41. As shown in FIGS. 1 and 2 the arc 31 is more readily transferred from the contacts 13, 15 to the arc chute 11 by providing a line arc horn or conductor 43 and a load arc horn or conductor 45 which extend from the zone adjacent the contacts to divergent locations 43*a*, 45*a* within the arc chute. The arc 31 progresses from position 31*a* to positions 31*b*, 31*c*, 31*d*, 31*e* through the elongated narrow arc chamber 41 and is extinguished under normal conditions.

In accordance with this invention, in order to minimize or eliminate any prior existing conditions which contribute to the continuation of an arc in the arc chute, such as the existence of vapor occurring due to thermal decomposition of melamine to provide formaldehyde and ammonia which are more electrically conductive than air, the surfaces 37, 39 are covered with coatings or layers 47, 49, respectively. The coatings 47, 49 comprise ceramic material that is arc resistant and refractory. Examples of the ceramic material include aluminum oxide ($Al_2O_3$), calcium oxide (CaO), chromic oxide ($Cr_2O_3$), magnesium oxide (MgO), and zirconium oxide ($ZrO_2$). The preferred coatings 47, 49 are comprised of $Al_2O_3$ or $ZrO_2$, because they are not only effective but comparatively inexpensive. The primary purpose of the coating 47, 49 is to minimize and eliminate the out-gassing of vapors into the arc chamber 41 from the arc chute portions 33, 35, by sealing the surfaces 37, 39. The coatings 47, 49 may be applied to either at least a portion or all of each surface 37, 39.

The method by which the coatings 47, 49 are applied comprises basically a two-step procedure as follows:

1. Sandblasting the surfaces 37, 39 to provide a roughened texture with a non-metallic grit; and 2. Spraying the surfaces 37, 39 to apply the high temperature, insulating material onto the surfaces.

The first step of roughening the surfaces, such as by sandblasting, is preferably performed with a non-metallic grit to avoid the deposit of any conducting material embedded in the surface that would otherwise result where a metallic grit is used. The second step of applying or spraying a high temperature and electrically insulating or non-conductive material onto the surfaces is preferably performed by flame spraying or plasma spraying of a powder of refractory or ceramic material, such as certain metal oxides including $Al_2O_3$, CaO, or $ZrO_2$, at elevated temperatures. $Al_2O_3$, CaO, $Cr_2O_3$, MgO, and $ZrO_2$ melt at 2045° C, 2590° C, 2280° C, 2800° C, and 2715° C, respectively. The oxides are applied as powders to a thickness of from about 0.001 to about 0.020 inch. A preferred thickness of the coatings 47, 49 is about 0.005 inch. A coating of 0.018 inch was tried and found to be too brittle. Thus, thinner coatings are preferred so long as they seal the surfaces 37, 39 against out-gassing of vapors into the arc chamber 41. Metallic oxide coatings are preferred because of their high temperature melting points and will therefore not decompose under prevailing arc chamber temperature operation. It was found that metallic carbonates decompose at such temperatures and are therefore not satisfactory.

The ceramic coatings or layers 47, 49 are preferably applied by flame spray with an oxy-acetylene heat source, or by plasma flame such as provided by flame spray equipment supplied by Metco, Inc. of Westbury, N.Y.

Accordingly, the application of a high temperature and arc resistant ceramic coating to an electrically insulating surface improves the arc interruption and quenching properties of an arc shield surface such as the surface of an arc chamber of an arc chute.

What is claimed is:

1. An arc chute comprising a heat resistant electrically insulating material comprising a melamine-formaldehyde resin, at least a portion of the surface being covered with a coating of an arc resistant ceramic material selected from the group consisting of calcium oxide and chromic oxide.

* * * * *